US009240620B2

(12) United States Patent
Nita

(10) Patent No.: US 9,240,620 B2
(45) Date of Patent: Jan. 19, 2016

(54) HIGH FREQUENCY FILTER

(75) Inventor: Jens Nita, Rosenheim (DE)

(73) Assignee: KATHREIN-WERKE KG, Rosenheim (DE)

( * ) Notice: Subject to any disclaimer, the term of this patent is extended or adjusted under 35 U.S.C. 154(b) by 787 days.

(21) Appl. No.: 13/382,086

(22) PCT Filed: Jun. 22, 2010

(86) PCT No.: PCT/EP2010/003803

§ 371 (c)(1),
(2), (4) Date: Jan. 3, 2012

(87) PCT Pub. No.: WO2011/000501

PCT Pub. Date: Jan. 6, 2011

(65) Prior Publication Data

US 2012/0133457 A1 May 31, 2012

(30) Foreign Application Priority Data

Jul. 1, 2009 (DE) ..... 10 2009 031 373

(51) Int. Cl.
*H01P 1/202* (2006.01)
*H01P 3/06* (2006.01)
(Continued)

(52) U.S. Cl.
CPC *H01P 1/202* (2013.01); *H01P 3/06* (2013.01); *H01P 7/04* (2013.01); *H01P 11/005* (2013.01)

(58) Field of Classification Search
CPC ..... H01P 1/202; H01P 1/2133; H01P 3/06; H01P 7/06; H01P 11/005; H01P 7/04
USPC ..... 333/206, 222
See application file for complete search history.

(56) References Cited

U.S. PATENT DOCUMENTS

| | | | | |
|---|---|---|---|---|
| 2,516,529 | A | 7/1950 | Raymond | |
| 2,630,490 | A * | 3/1953 | Richards | 333/206 |
| 3,167,729 | A | 1/1965 | Hall | |
| 3,792,385 | A | 2/1974 | Napoli et al. | |

(Continued)

FOREIGN PATENT DOCUMENTS

| | | |
|---|---|---|
| CN | 1815801 A | 8/2006 |
| DE | 19907413 | 8/2000 |

(Continued)

OTHER PUBLICATIONS

Chinese Search Report dated Sep. 4, 2013, issued in corresponding Chinese Application No. 201080029184.4.

(Continued)

*Primary Examiner* — Benny Lee
*Assistant Examiner* — Rakesh Patel
(74) *Attorney, Agent, or Firm* — Nixon & Vanderhye P.C.

(57) ABSTRACT

The invention relates to an improved high frequency filter (high pass filter) that is characterized by the following features: in addition to the at least both capacitively coupled inner conductor front faces (5*b*) or the capacitively coupled inner conductor end segments (5*c*) of two coupled inner conductor segments (5*a*), at least one further inner conductor coupling device (15) or at least one further inner conductor coupling element (115) is provided, the at least one further inner conductor coupling device (15) or the at least one further inner conductor coupling element (115) is arranged in an at least partially overlapping manner with the inner conductor end segments (5*c*) of the coupled inner conductor segments (5*b*), and the branch line (7) runs between the inner conductor coupling device (15) or the inner conductor coupling element (115) and the outer conductor (1).

26 Claims, 14 Drawing Sheets

(51) Int. Cl.
*H01P 7/04* (2006.01)
*H01P 11/00* (2006.01)

(56) References Cited

U.S. PATENT DOCUMENTS

| | | | |
|---|---|---|---|
| 3,980,976 | A | 9/1976 | Tadama et al. |
| 2006/0170522 | A1 | 8/2006 | Jakob |
| 2009/0153270 | A1 | 6/2009 | Beerwerth |
| 2010/0277260 | A1 | 11/2010 | Haunberger et al. |

FOREIGN PATENT DOCUMENTS

| | | |
|---|---|---|
| DE | 10328881 | 1/2005 |
| FR | 2266331 | 10/1975 |
| GB | 2091977 | 8/1982 |
| WO | WO 2004/079795 | 9/2004 |

OTHER PUBLICATIONS

International Search Report for PCT/EP2010/003803 mailed Oct. 25, 2010.

Written Opinion of the International Searching Authority mailed Oct. 25, 2010 (IN German).

Matthei, Young, Jones, "Microwave Filters, Impedance-Matching, Networks and Coupling Structures", McGraw-Hill Book Company, Inc. 1964, p. 414-416.

* cited by examiner

1'
1
2A
T
15,1A5
1b
T
1c 3
2A
5a,5c 23
15d 15c
15,1A5

1a
1,1'
5a,5c
15b
15,1A5

15b
15c 15d
15,1A5

1a
5b
15,1A5
23'
23
1'

1a
3,2A
15c
15,1A5

3,2A
15d
1a
1

15d
5a,5c
15,1A5

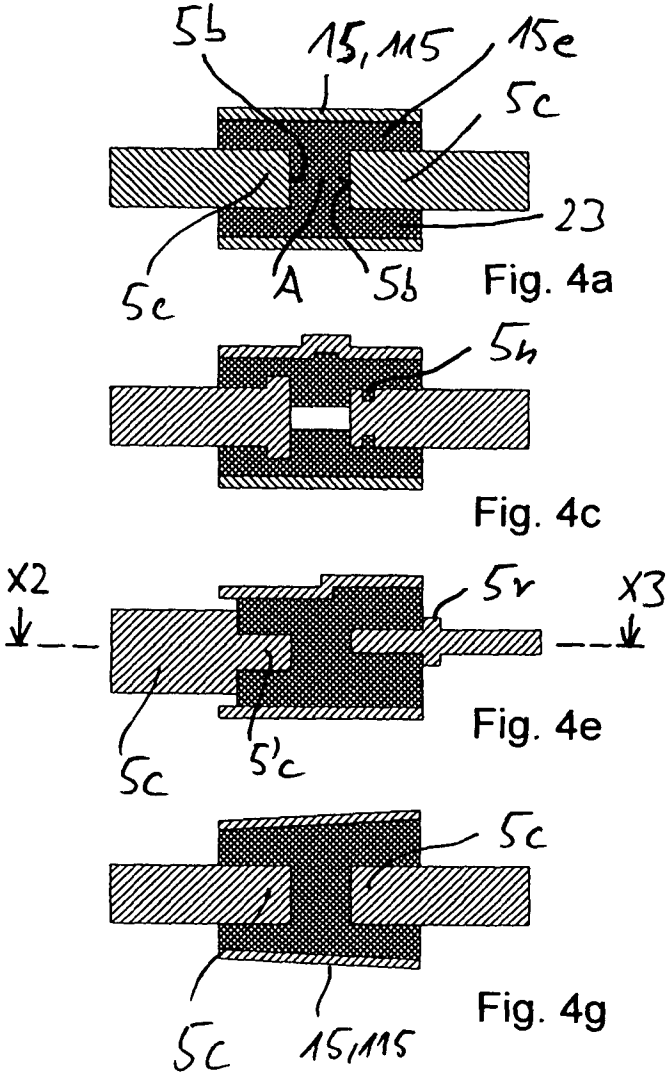
15e
5c
23
15,15
5b
A
5b
5c
Fig. 4a
5h
Fig. 4c
X3
5r
5'c
5c
X2
Fig. 4e
5c
15,15
5c
Fig. 4g
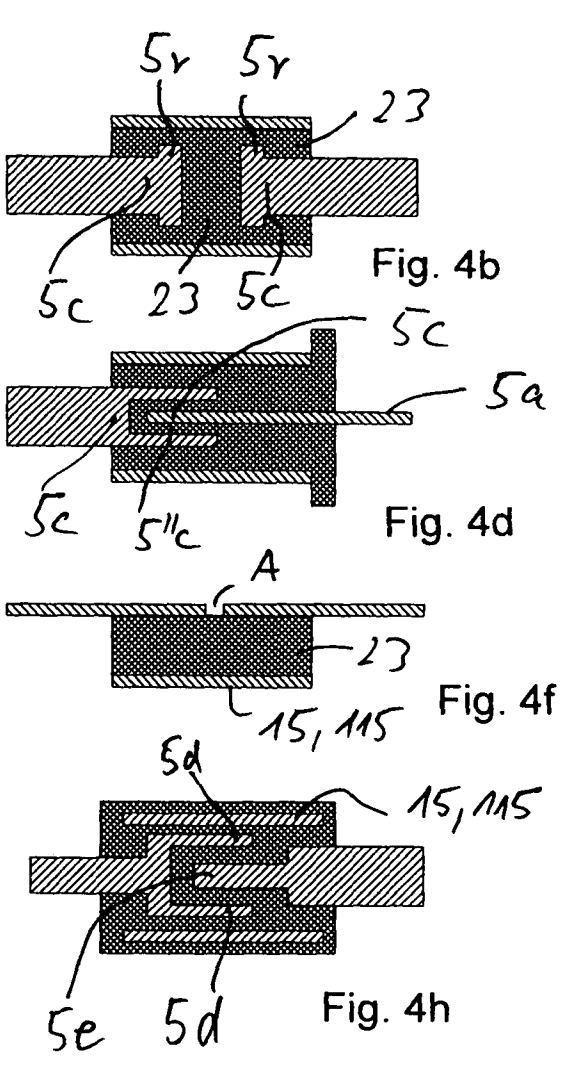
23
5r
5r
5c
23
5c
Fig. 4b
5c
5a
5''c
5c
Fig. 4d
23
A
15,15
Fig. 4f
15,15
5d
5d
5e
Fig. 4h -- Prior Art --

--Prior Art --

OK TO ENTER: /R.P./

-- Prior Art --

HIGH FREQUENCY FILTER

This application is the U.S. national phase of International Application No. PCT/EP2010/003803 filed 22 Jun. 2010 which designated the U.S. and claims priority to DE 10 2009 031 373.7 filed 1Jul. 2009, the entire contents of each of which are hereby incorporated by reference.

FIELD

The invention relates to a high frequency filter, i.e. a so-called high pass filter.

BACKGROUND AND SUMMARY

In radio systems, for example in the mobile communication field, it is often desirable to use only one common antenna for transmitted and received signals. Transmitted and received signals use different frequency ranges. The antenna which is used must be suitable for transmitting and receiving in both frequency ranges. To separate the transmitted and received signals, suitable frequency filtering, which ensures that on the one hand the transmitted signals are passed on from the transmitter only to the antenna (and not in the direction of the receiver), and on the other hand the received signals are passed on from the antenna only to the receiver, is necessary.

For this purpose, a pair of high frequency filters can be used, both of them letting through a specified (i.e. the desired) frequency band (band pass filter), or a pair of high frequency filters, which both block a specified (i.e. the not desired) frequency band (band stop filter), or a pair of high frequency filters, consisting of one filter which lets through frequencies below a frequency between the transmission and reception bands and blocks those above it (low pass filter), and a filter which blocks frequencies below this frequency between the transmission and reception bands and lets through those above it (high pass filter). Other combinations of the above-mentioned filter types can also be used.

High frequency filters of the described type can be differently structured. A known high pass filter can consist of a hole or a channel in a milled or cast housing, inner conductor sections being arranged in the channel or hole and connected galvanically via so-called stubs to the outer conductor. The inner conductor sections (if the whole arrangement is to have a compact size) usually have interruptions of very small dimensions, so that the corresponding inner conductor sections are capacitively coupled on their faces. The size of the capacitive couplings between the wire sections is inversely proportional to the change of distance. The face-side capacitive coupling between the inner conductors rises further with increasing cross-section surface of the wires and increasing dielectric constant of the material which can be in the gap between the wires. Since, in the case of coaxial high pass filters which are known in the prior art and in corresponding form, relatively high capacitances are usually necessary, the gap between the faces of the inner conductor sections, which are positioned in axial extension to each other (if, as mentioned, comparatively compact outer dimensions are to be maintained), is usually less than 0.5 mm (e.g. when installed in a base station or other antenna facility). The gap is often around 0.1 to 0.2 mm.

On the basis of FIG. 12*a*, a corresponding coaxial high pass filter is shown in schematic axial longitudinal section (e.g. in plan view, without showing the cover which seals the outer conductor), and in FIG. 12*b* it is shown in axial cross-section (with a cover which seals the outer conductor), as it is known from the prior art. Differently from this form, the housing can also be divided into two or more parts, e.g. include two housing sections or housing halves which can be joined together. Similarly, the outer conductor housing can also be completely closed, so that the inner conductor arrangement is only pushed axially into this outer conductor housing. In this respect there are no restrictions.

From this it can be seen that such a coaxial high pass filter includes an outer conductor 1, which—as mentioned—usually consists of a milled or cast housing (metal, metal alloy), in which an axial hole or axial channel 3 is formed. Along this hole or channel 3, an inner conductor arrangement 5, consisting of multiple inner conductor sections 5*a*, is then provided. The inner conductor sections end with their inner conductor faces 5*b* at a short distance A, so that between the inner conductor faces 5*b* and thus the inner conductor sections 5*a* the result is a capacitive coupling. Also, for example, between these inner conductor faces 5*b* a dielectric D can be inserted.

The individual inner conductor sections 5*a* are galvanically coupled (usually centrally) to the outer conductor 1 via a branch wire 7 which runs transversely or perpendicularly to the associated inner conductor section 5*a*, the corresponding branch wires 7 running in lateral branch wire channels 9 (i.e. branch wire recesses 9) in the material of the outer conductor 1, and being connected galvanically to the branch wire channel floor 9*a* with the above-mentioned outer conductor 1 (the outer conductor 1 virtually representing the housing of the thus formed high pass filter).

Such a high pass filter in coaxial structure is to be taken as known, for example through Matthei, Young, Jones: "Microwave Filters, Impedance-Matching Networks, and Coupling Structures", McGraw-Hill Book Company 2001, namely on page 414 (FIG. 7.07-3).

On the basis of FIG. 12*c*, a corresponding equivalent circuit diagram for the high frequency filter which is known according to the prior art and FIGS. 12*a* and 12*b* is reproduced. From it, it can be seen that a single inner conductor 5 is provided with individual inner conductor sections 5*a*, a capacitance $C_1$ being formed between two inner conductor sections 5*a*, and the branch wire 7, running from the inner conductor sections 5*a*, which are continuous in themselves, to earth or the outer conductor 1, being connected in the form of an inductor I.

By the paired capacitive coupling of multiple wire sections or wire parts (in which the coupling can take place via a dielectric consisting of air or another material) and its galvanic connection to the outer conductor, the desired response behaviour of the thus formed high pass filter is generated. The extent of the capacitive coupling is determined by the size of the two opposite faces of the inner conductor sections which are coupled via them, by the distance A between the two face-side inner conductor sections, and the dielectric which is used between the two face-side inner conductor sections.

A comparable solution to the prior art corresponding to the representation according to FIGS. 12*a* and 12*b* has also become known from US 2009/0153270 A1, which corresponds to DE 10 2007 061 413 A1. A high pass filter with an inner conductor which comprises individual inner conductor sections is shown. Two successive inner conductor sections in axial extension to each other are arranged at a distance from each other, the faces facing each other and a subsequent inner conductor section, in a partial length, dipping into a tubular intermediate piece, which in the centre, between the two faces of the successive inner conductor sections, has a closed wall section. In this way, in the signal direction, a first coupling between the inner conductor end section, which dips into the tubular intermediate section, and the thus formed first tubular capacitor is generated, a second tubular capacitor being formed at the opposite end of the tubular intermediate piece between the tubular jacket section and the end section, which dips in there, of the nearest adjacent inner conductor section. At the face-side boundaries of the tubular intermediate piece, a spiral wire section then runs from the inner conductor to the outer conductor, so that coils are formed.

The result of this construction is an inner conductor section with, in contrast to the embodiment according to FIG. 12*a*, an inserted and successive doubled capacitive coupling from the end of one inner conductor section to the tubular intermediate piece and from the tubular intermediate piece to the next inner conductor section.

However, with increasing requirements for the blocking characteristics of high pass filters, multiple such inner conductor sections must be connected one behind the other to generate corresponding stop band attenuation.

The disadvantage of the high pass filters which have become known until now in corresponding coaxial structure is that correspondingly many wire sections must be arranged one behind the other to be able to implement the corresponding requirements for high pass filters, above all in the field of mobile communications. As mentioned, very small gaps must be maintained between the wire pieces to ensure sufficiently high capacitive couplings. The result of this is that the tolerance sensitivity of the structures is very high.

In contrast, it is the object of the present invention to create an improved high frequency filter (a so-called high pass filter) which, with a preferably more compact design, makes it possible to steepen the stop band.

It can and must be called quite surprising that compared with the prior art, a clearly improved high pass filter, which makes improved electrical properties and space-saving construction possible, is achievable within the invention. Additionally, the high pass filter according to the invention is distinguished by clearly improved tolerance sensitivity compared with the prior art.

The high pass filter according to the invention can also be used as a single filter, but also connected to one or more similar or different high frequency filters. The result, as a favourable application case, is also the use of the high frequency (HF) filter according to the invention in mobile communications, and there in particular in duplex filters, which—as explained above—are required in order to separate the transmitted signals which are fed into an antenna from the received signals which are received via the same antenna, and which are transmitted or received in offset frequency ranges.

The solution according to the invention consists substantially of fitting an additional inner conductor coupling element into the high frequency filter track, this additional inner conductor coupling element either being metallic and thus electrically conductive, or consisting of a metallically and/or electrically conductively coated dielectric, or including the latter. The additionally applied inner conductor coupling element according to the invention is provided in the region of the face-side coupling of the inner conductor sections. If this inner conductor coupling element is in the form of a hollow cylinder, for example, or in general provided with an inner recess, in this inner conductor coupling element the ends of the adjacent inner conductor sections, i.e. the relevant inner conductor faces, can be fully or at least partly opposite each other within the inner conductor coupling element. However, it is also possible that the inner conductor coupling element is arranged overlapping with the inner conductor sections which work with it only in a partial peripheral region, thus for example overlaps only over an axial length of the relevant face of the inner conductor section with the end region of the associated inner conductor section, in order to achieve the additional coupling here.

Also, in contrast to the prior art, the inner conductors are connected electrically to the outer conductor not by the inner conductor sections, but by corresponding branch wires from the inner conductor coupling elements.

Within the invention, by constructing a high pass filter which is structured in this way, a series of surprising advantages can be achieved.

Within the invention, it is possible to generate, below the frequency pass band, blocking poles which thus contribute to considerable steepening of the filter characteristic below the frequency pass band.

With every high pass filter according to the invention, a blocking pole can be achieved by using a corresponding inner conductor coupling element. In other words, multiple such structures can be connected one behind the other (in series), in which case multiple additional blocking poles can be generated by corresponding tuning. For completeness only, we mention here that the high pass filter according to the invention, while generating one or more blocking poles, can also be combined with other, conventional high pass filter structures. In this respect too there are no restrictions.

Within the invention, the structure of the high frequency filter can also be significantly shortened compared with the prior art. The overall result is more compact overall dimensions.

The sensitivity of the capacitive electrical coupling is also reduced by using the inner conductor coupling element.

The invention also results in a cost advantage, since the invention means that there is only a relatively small additional expenditure for the additionally provided inner conductor coupling elements, these additional costs being less compared with the additional costs of the serial circuit of additional inner conductor sections, such as are necessary today according to the prior art.

Finally, within the invention, the mechanical stability can also be increased using the inner conductor coupling elements. Above all, this applies in the case of corresponding use of a dielectric in solid form, i.e. not in air, because in this way the inner conductor sections, the inner conductor coupling elements and/or the branch wires can also be stabilised and held.

In other words, the dielectric, which is at least partly in the inner conductor coupling element in which the inner conductor sections end, can take an additional positioning function of the inner conductor coupling element and thus also of the inner conductor sections, above all when the dielectric is provided outside the inner conductor coupling element in the corresponding receiving space (hole, channel) of the outer conductor arrangement. Also, further dielectrics for mechanical stabilisation within the structures are possible, e.g. also coated dielectrics.

The structures according to the invention make it possible to transmit high powers. The result is also—which in particular is very important in mobile communications—altogether good intermodulation behaviour.

Finally, it can and must be noted that furthermore, within the solution according to the invention, good heat dissipation via the inner conductor coupling elements and for example the galvanic coupling to the outer conductor is achieved.

A further possible improvement within the invention is that the coupling of the inner conductor structures between the inner conductor coupling elements and the outer conductor does not necessarily have to be by the corresponding branch wires being connected galvanically to the outer conductor. It is also possible that the branch wires are capacitively coupled to the outer conductor. In this case too, the fixed dielectric which may exist in the outer conductor interior can also be used for positioning and fixing the branch wires which are capacitively coupled to the outer conductor.

Summarising, therefore, it can be recorded that within the invention, a high frequency filter is created, namely a so-called high pass filter, in which, by targeted addition of a structure, also called an inner conductor coupling element below, a blocking pole below the pass band can be generated. If multiple such structures are connected in series, in this way multiple blocking poles below the pass band can be generated. Such an inner conductor coupling element can be electrically conductive, e.g. because it consists of a metal or a metallic structure, or it can be formed from or include a dielectric, which for example has an electrically conductive coating. Such a version according to the invention of one or more additional blocking poles results in a clear steepening of the stop band and a shortened design, with simultaneous tolerance insensitivity of the high pass filter compared with previous solutions. The invention can be used both as an individual filter and in connection to one or more similar or different high frequency filters. One of the main applications, in addition to the single filter, is in the use with so-called duplex or, for example, triplex filters.

BRIEF DESCRIPTION OF THE DRAWINGS

Further advantages, details and features of the invention are given in the embodiments, which are explained on the basis of drawings. In detail:

FIGS. 4*a* to 4*h* show eight different embodiments in schematic axial longitudinal section, to clarify the coupling of two inner conductor end sections using an inner conductor coupling element;

DETAILED DESCRIPTION

Below, on the basis of FIGS. 1*a* and 1*b*, reference is made to a first embodiment according to the invention.

Figure 12B:
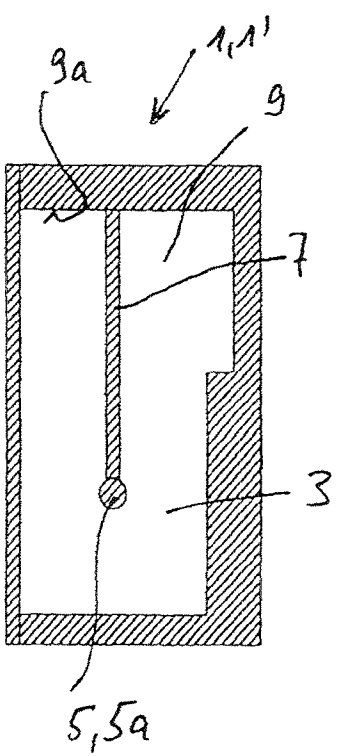
FIGS. 12*a* and 12*b* are a schematic axial longitudinal section and a cross-section along the line X-X in FIG. 12*a*, for a high pass filter in coaxial structure according to the prior art.
Figure 12A:
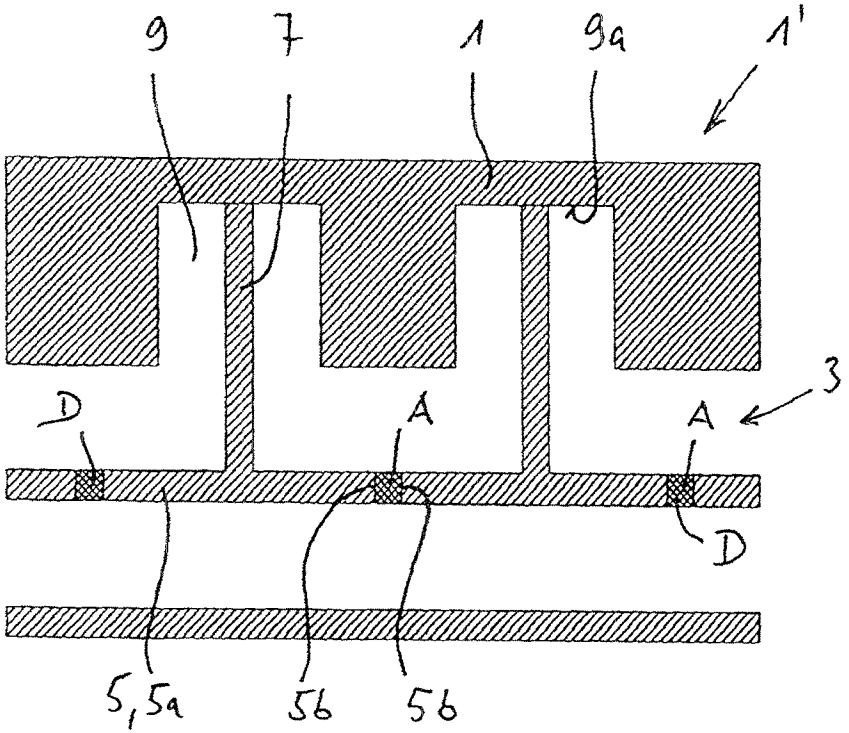
Figure 12C:
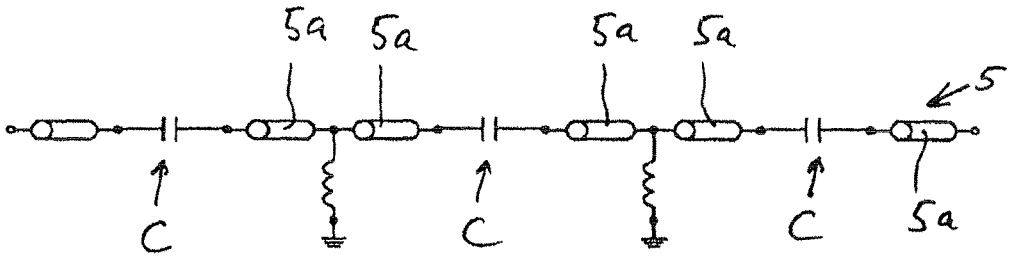
FIG. 12*c* is an equivalent circuit diagram concerning a high pass filter in coaxial structure according to the prior art, as it is reproduced on the basis of FIGS. 12*a* and 12*b*.

This embodiment according to the invention differs from the high frequency filter in coaxial construction according to the prior art according to FIGS. 12*a* and 12*b*, among other ways in that now, in the region of the inner conductor end sections 5*c*, an inner conductor coupling device 15 of the type of an inner conductor coupling element 115, via which the inner conductor end sections 5*c* overlap over a certain axial length, is provided.

Figure 1B:
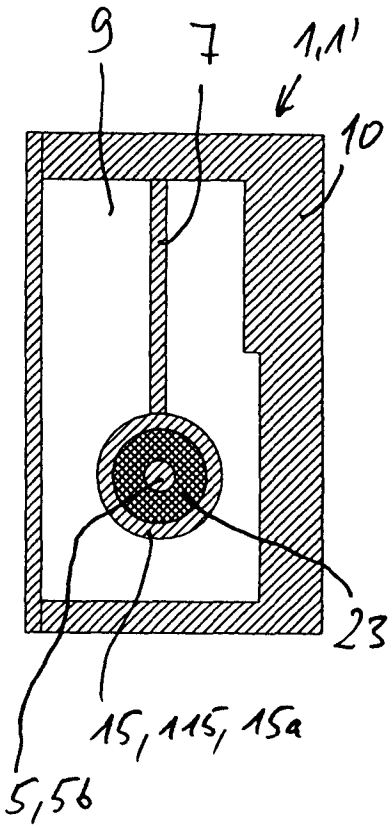
FIG. 1*b* is an axial cross-section along the line I-I in FIG. 1*a;*
Figure 1A:
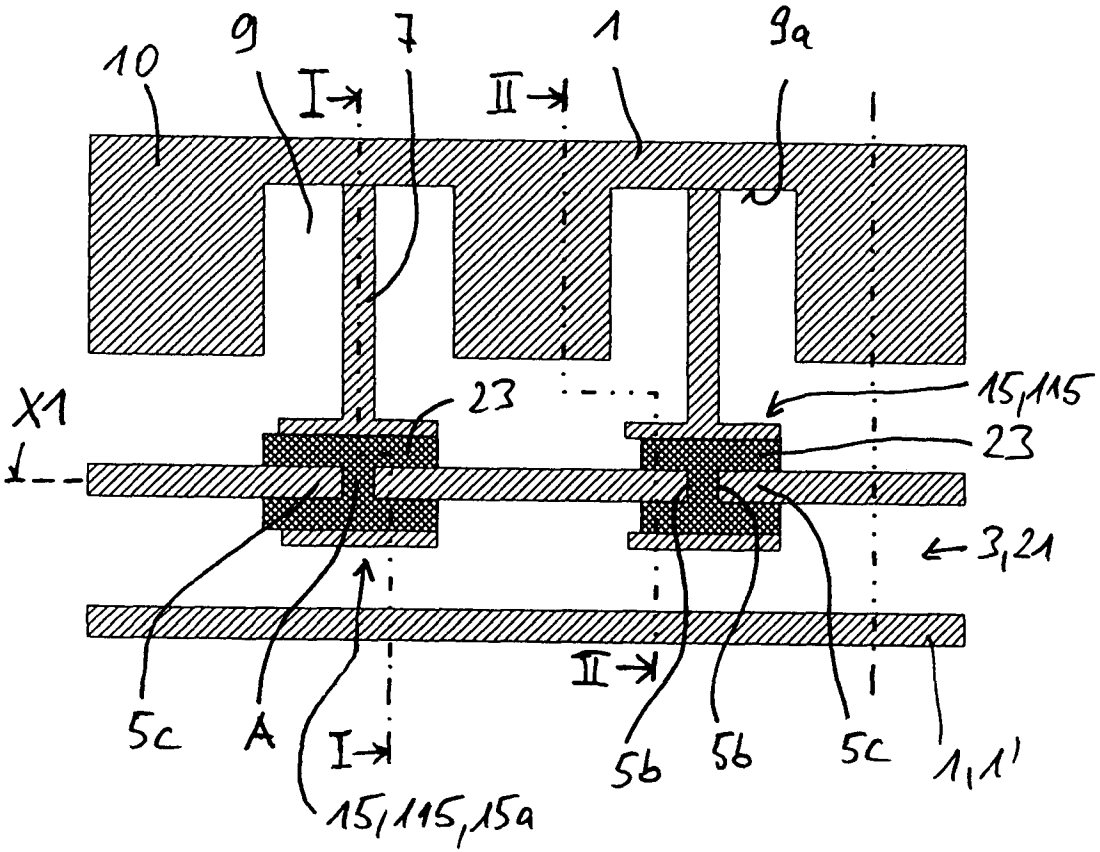
FIG. 1*a* shows a schematic axial longitudinal section through a first embodiment of the invention.

In the shown embodiment according to FIGS. 1*a* and 1*b*, the inner conductor coupling element 15 is in the form of an inner conductor coupling cylinder 15*a*, into which the inner conductor end sections 5*c* dip with a certain axial length, the inner conductor faces 5*b* of the inner conductor sections 5*a*, which are positioned in axial extension of each other, coming to be at a distance A from each other.

In the shown embodiment, the inner conductor end sections 5*a* are arranged on a common axial line X1 in direct axial extension of each other, and dip coaxially into the inner conductor coupling cylinder 15*a*.

In principle, the individual inner conductor sections can be held and anchored by dielectric spacers in the inner conductor space 21, which for example is in the form of a channel 3, against the outer conductor 1 (i.e. the outer conductor housing 10), e.g. also by the whole inner conductor space 21, or only certain sections of the inner conductor space, being filled or plugged with a solid dielectric. Similarly, multiple dielectric structures, via which individual regions of the inner conductor sections can be mechanically held and supported relative to the outer conductor, can for example be provided at an axial distance in the inner conductor space 21.

In the shown embodiment, a dielectric 23, via which the individual inner conductor sections 5*a* are held and positioned by the inner conductor coupling cylinder 15*a*, is provided in the region of the inner conductor coupling device 15, i.e. within the inner conductor coupling cylinder 15*a*, preferably not of air but of a solid material (e.g. plastics material, ceramic etc.).

In the embodiment according to the invention, the branch wires 7, which have already been explained in the prior art, are not coupled to the individual inner conductor sections 5*a* but connected electrically-galvanically to the appropriate inner conductor coupling device 15, i.e. the inner conductor coupling element 115, and preferably lead transversely and in the shown embodiment perpendicularly to the axial extent X1 of the inner conductor 5 in a corresponding branch wire channel 9 to the branch wire channel floor 9*a* in the outer conductor housing 10, and are connected electrically-galvanically to the outer conductor 1, i.e. the outer conductor housing 10, opposite the inner conductor coupling device 15.

However, the individual branch wires can also be in a second wire channel in the floor of the outer conductor housing and/or on opposite sides of the outer conductor. In this respect there are no restrictions.

As is also shown by the axial longitudinal section according to FIG. 1*a*, the dielectric, which in this embodiment is preferably formed by a solid dielectric 23, does not have to extend over the whole axial length of the inner conductor coupling cylinder 15*a*, but can end before the face-side end of the inner conductor coupling cylinder 15*a* (as is shown in FIG. 1*a* for the coupling example on the right), or can even project beyond the inner conductor coupling cylinder 15*a* in the axial direction (as is shown in the embodiment according to FIG. 1*a* for the coupling on the left).

The result of the solution according to the invention, with uses of the coupling device 15, is two capacitive couplings connected in series, namely, for example, a first coupling from the inner conductor end section 5*b* to the inner conductor coupling device 15 and from the inner conductor coupling device 15 to the nearest adjacent inner conductor end section 5*c* of a subsequent adjacent inner conductor end section 5*b*. These capacitive couplings correspond functionally to the face-side coupling between the faces 5*b* in the case of the high pass filter according to the prior art, as it is explained on the basis of FIGS. 12*a* and 12*b*. Now, in the case of the invention, the above-mentioned capacitive coupling in series additionally generates, via the novel inner conductor coupling device 15, the capacitive coupling which is provided between the faces 5*b*, said capacitive coupling now, in this structure according to FIGS. 1*a* and 1*b*, acting to generate additional blocking poles, to improve the edge of the high pass filter compared with the prior art.

Figure 1C:
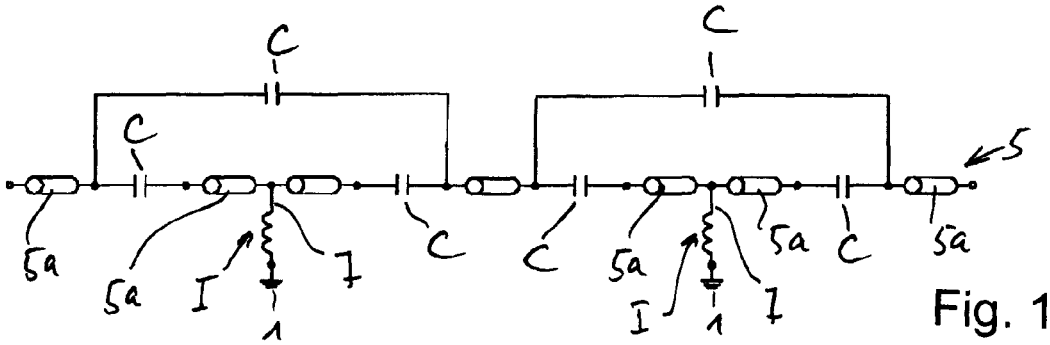
FIG. 1*c* is an equivalent circuit diagram for the embodiment according to FIGS. 1*a* and 1*b;*
Figure 1D:
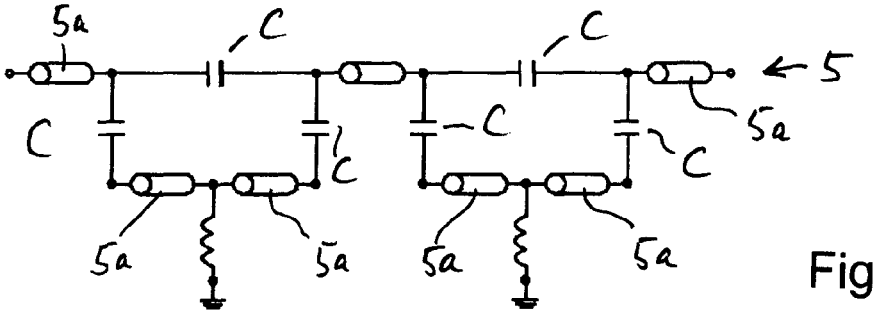
FIG. 1*d* is a corresponding equivalent circuit diagram, basically as shown on the basis of FIG. 1*c*, but in more compact form compared with FIG. 1*c;*

FIG. 1*c* is an equivalent circuit diagram of the solution according to the invention according to FIGS. 1*a* and 1*b*, whereas in FIG. 1*d* the equivalent circuit diagram is reproduced in more compact representation compared with the representation in FIG. 1*c*.

From this it should be taken that within the invention, by introducing new capacitances $C_2$, a further capacitive coupling, through which finally two blocking poles can be implemented by two signal paths P1 and P2, is now created.

Figure 1E:
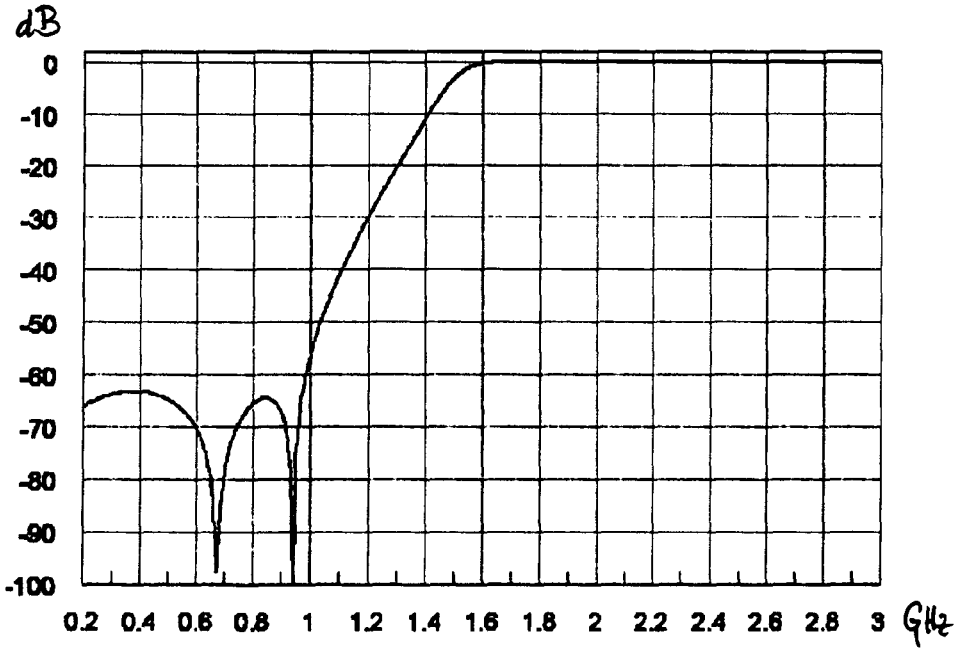
FIG. 1*e* is a diagram to represent the attenuation course in the case of an embodiment corresponding to FIGS. 1*a* to 1*d*, with formation of two blocking poles, caused by the capacitances on the two signal paths.

A diagram in which on the vertical Y axis the pass attenuation in dB is drawn, and on the horizontal X axis the frequency in GHz for a high frequency filter is drawn, is then reproduced as FIG. 1*e*. The attenuation course concerns an embodiment as it was implemented for the solution according to the invention and according to FIGS. 1*a* to 1*d*, with an attenuation of, for example, 200 MHz to 960 MHz, the attenuation being greater than 60 dB. In the diagram according to FIG. 1*e*, the formation of two blocking poles, which are caused by the capacitive couplings on the two signal paths, can clearly be seen. This improvement according to the invention is neither possible nor known in the case of the conventional solution.

As is given on the basis of the schematic cross-sections according to FIGS. 2*a* to 2*k*, the cross-section shape of the outer conductor, the cross-section shape of the inner conductor, the cross-section shape of the inner conductor coupling device and the cross-section shape of the dielectric 23 which, for example, is provided between the inner conductor end sections and the inner conductor coupling device 15, can have a very wide variety of shapes, in particular cross-section shapes.

In the case of the schematic cross-sections according to FIGS. 2*a* to 2*k*, the outer conductor housing extensions 1' are shown with greater material extent, in which the above-mentioned branch wire recesses or channels 9 are housed to receive the branch wires. However, if appropriate the outer conductor housing does not have to be provided with an outer conductor housing extension 1', but can in general be in tubular form (with any cross-section shape), so that the branch wires 7 are connected directly to the inner wall of the outer conductor housing or outer conductor tube, in general of the outer conductor.

The branch wire recesses can also be in the outer conductor region or in the cover, in which recesses are made correspondingly.

FIGS. 2*a* to 2*k* show that, for example, the outer contour of the outer conductor 1 can be rectangular or square or in general n-polygonal. However, the outer conductor can finally also have a cross-section shape which is round or round in sections, at least on its outside. It can be oval or also cylindrical. There are no restrictions to specified cross-section shapes or outer contours.

FIGS. 2*a* to 2*d* also show that, for example, the cross-section shape of the inner conductor space 21, at least outside the region in which the branch wire recesses or channels 9 are provided in the outer conductor 1, can have a square or rectangular, cylindrical or in general n-polygonal cross-section shape, which is formed by the outer conductor inner surface 1*a*.

FIGS. 2*a* to 2*k* also show that the inner conductor 5, i.e. the inner conductor sections 5*a* and in particular the inner conductor end sections 5*c*, can have different cross-section shapes, e.g. round cross-section shapes, square or rectangular cross-section shapes, in general n-polygonal cross-section shapes. But oval cross-section shapes or mixed shapes for the inner conductor cross-section are also possible, as is a cross-section shape in which rounded transition areas between the various side surfaces are provided. However, elliptical cross-section shapes, etc. are also conceivable. In this respect there are no restrictions.

The cross-sections according to FIGS. 2*a* to 2*k* also show that above all the inner conductor coupling devices 15 can have a very wide variety of cross-section shapes, e.g. of the type of a hollow cylinder with round cross-section shape or with angular cross-section shape, or at least partly or in sections with an angular or square outer surface 15*b* and inside it an inner surface 15*c* which is also partly or in sections round, square or in general n-polygonal. Here too, there can be a transition from the individual wall sections, i.e. the individual surfaces on the outside or inside of the inner conductor coupling element 115, via corners or roundings into the nearest adjacent wall sections.

Figures 2A, 2B, 2C, 2D, 2E, 2F, 2G, 2H, 2I, 2J, 2K:
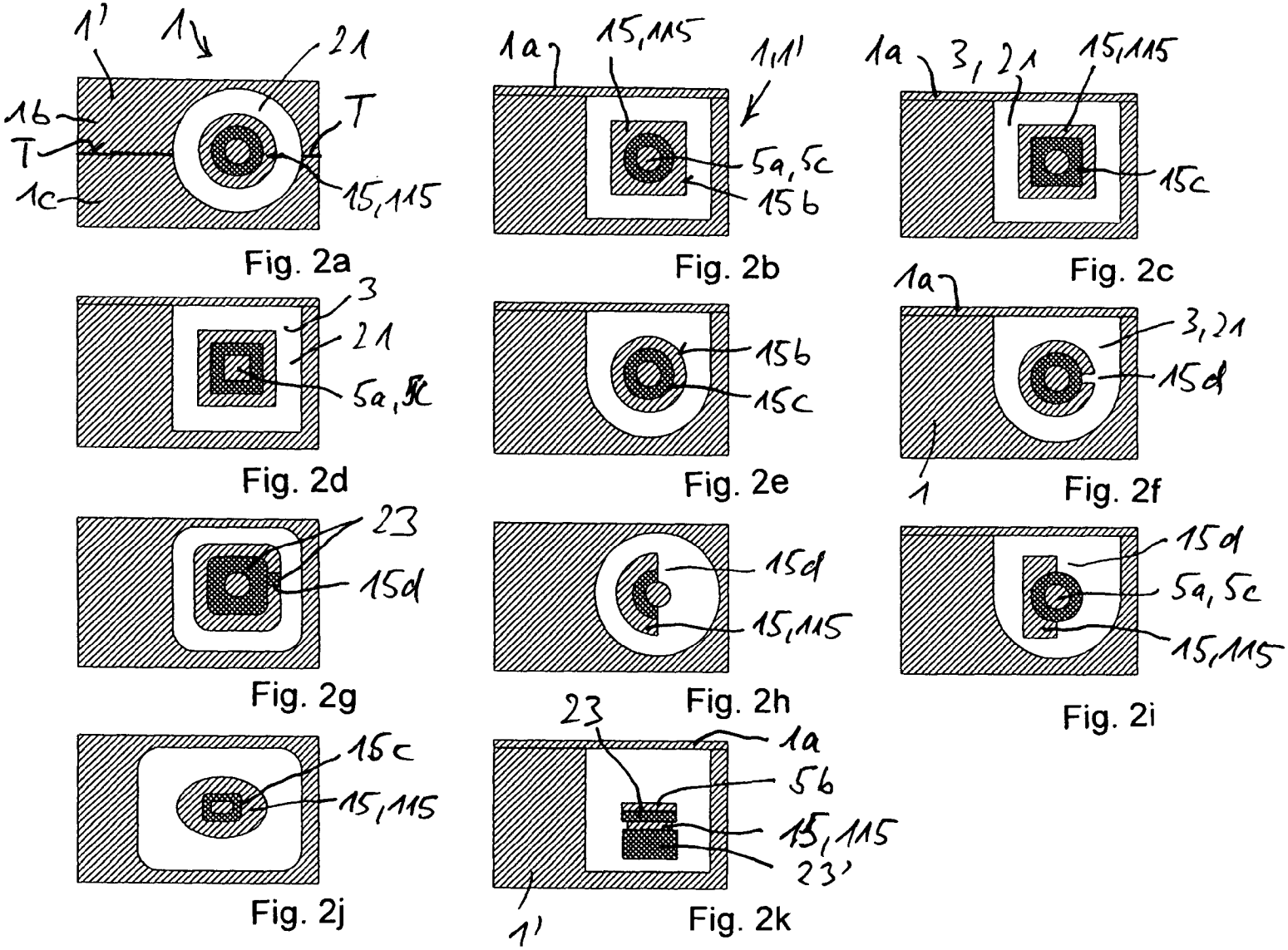
FIGS. 2*a* to 2*k* are eleven further schematically reproduced cross-sections along the line II-II in FIG. 1*a*, to clarify various inner conductor and outer conductor cross-section shapes and various cross-sections of the (solid) dielectric which, for example, is provided between the inner conductor sections and the inner conductor coupling elements.

On the basis of FIG. 2*j*, it is shown that, for example, the inner conductor coupling device 15, with reference to its outer surface 15*b*, can have an oval cross-section shape, and in contrast the surfaces 15*c* facing inward to the inner conductor end sections can have a cross-section shape which differs from it, e.g. a cross-section shape which approaches a square or rectangle.

The example according to FIG. 2*f* also shows that the inner conductor coupling element 115 is not completely closed in the peripheral direction, but can be provided with an opening section 15*d*, similarly to the case of the embodiment according to FIG. 2*g*. In the case of the embodiment according to FIG. 2*g*, the opening region 15*d* and the gap between inner conductor end section 5*b* and inner conductor coupling device 15 are filled with a dielectric.

The examples according to FIGS. 2*h* and 2*i* also show that the inner conductor coupling element 115, for example, can usually be arranged only in a side region or partial peripheral region—relative to the inner conductor sections—parallel or in general more or less in the overlapping direction to the inner conductor end sections 5*c*, in order to generate here, as well as the capacitive coupling between the inner conductor faces 5*b* (which should be in contact with each other) of two inner conductor sections 5*a* which are arranged in extension to each other, an additional coupling between the appropriate inner conductor end section 5*b* to the inner conductor coupling element 115 and from the inner conductor coupling element 115 to the nearest adjacent inner conductor end section of a nearest inner conductor section 5*a*.

FIGS. 2*f*, 2*g*, 2*h* and/or 2*i* or 2*j* show that the inner conductor coupling device 15 can surround the inner conductor end sections 5*c* to be coupled in a surrounding range of more than 10°, in particular more than 20°, 30°, 40°, 50°, 60°, 70°, 80°, 90°, 100°, 110°, 120°, 130°, 140°, 150°, 160°, 170°, 180°, 190°, 200°, 210°, 220°, 230°, 240°, 250°, 260°, 270°, 280°, 290°, 300°, 310°, 320°, 330°, 340°, 350°.

The same cross-sections also show that the inner conductor coupling device 15 can surround the inner conductor end sections 5*c* to be coupled by less than 360°, 350°, 340°, 330°, 320°, 310°, 300°, 290°, 280°, 270°, 260°, 250°, 240°, 230°, 220°, 210°, 200°, 190°, 180°, 170°, 160°, 150°, 140°, 130°, 120°, 110°, 100°, 90°, 80°, 70°, 60°, 50°, 40°, 30° and in particular less than 20°.

In the case of the embodiment according to 2*h*, for example, it is shown that the inner conductor coupling element 115 can be semicylindrical in cross-section shape, the variant according to FIG. 2*i* showing that the shape of the coupling element 115, even if it encloses the inner conductor end sections only in a partial surrounding range or is arranged for this purpose, can have an outer contour 15*b* which differs from the inner contour 15*c*, for example can be semicylindrical on the inside or rectangular on the outside. These examples show that in this respect there are no restrictions regarding the shape and/or arrangement of the inner conductor coupling device 15.

The embodiment according to FIG. 2*k* also shows that, for example, the corresponding inner conductor end sections 5*b* and the inner conductor coupling device 15, which usually runs parallel to it, can be of a flat shape, i.e. including a plate-shape, i.e. formed as planar material, preferably with a dielectric 23, which is again plate-shaped in cross-section, between them. In the shown embodiment according to FIG. 2*k*, below them and again below the one inner conductor end section, a further dielectric 23' (rectangular in cross-section), which can also be provided on the coupling device, is provided.

Finally, some of the embodiments also show that the outer conductor can be in the form of a closed complete housing, with a corresponding inner conductor channel 3. In the case of the variants according to FIGS. 2*b*, 2*c*, 2*d*, 2*f*, 2*g*, 2*i* and 2*k*, it is also shown that the outer conductor housing is divided in two and includes an actual housing section, which is sealed by a preferably detachable outer conductor housing cover 1*a*. Alternatively and additionally, for example on the basis of FIG. 2*a*, the drawing shows that the housing can also consist of two housing halves 1*b* and 1*c*, which can be separated along a separation plane T, preferably centrally at the height of the inner conductors. However, this separation plane can also be formed in a different position, and does not have to be in the plane of the inner conductor sections, so that the two housing parts are of different sizes. Any modifications are possible here.

Finally, on the basis of the explained FIGS. 2*a* to 2*k*, it is noted that with reference to all contours, cross-section shapes, internal surfaces or outward facing surfaces of the outer conductor, inner conductor sections, coupling elements, dielectrics etc., many mixed forms can be provided, and the schematic cross-sections according to FIGS. 2*a* to 2*k* are intended to show only some of the possible variants.

Figure 3B:
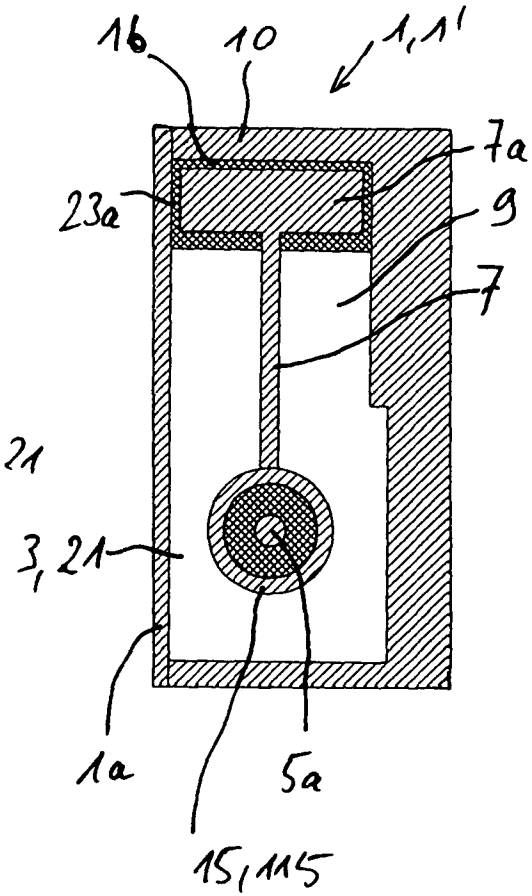
FIG. 3*b* is a cross-section through the embodiment according to FIG. 3*a*, along III-III.
Figure 3A:
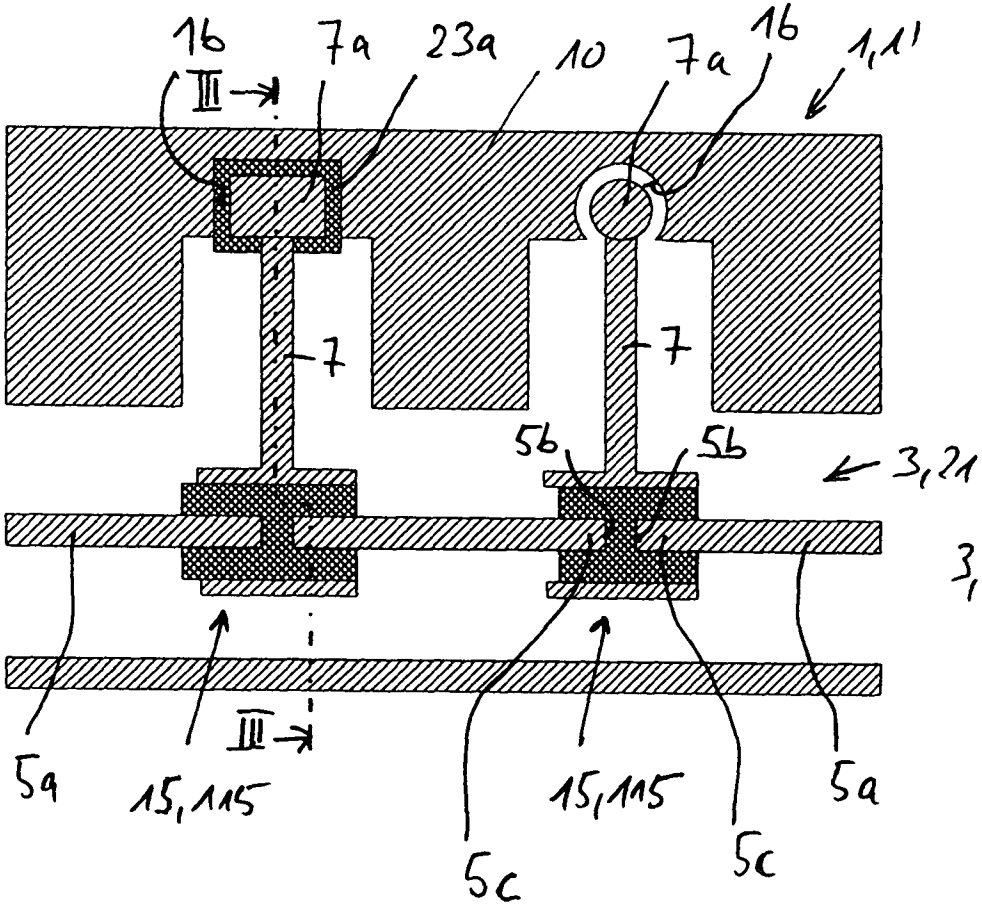
FIG. 3*a* is an axial longitudinal section similar to FIG. 1*a*, with reference to a further embodiment, in which, among other things, the branch wires are coupled capacitively to the outer conductor.

On the basis of FIG. 3*a*, in a schematic axial longitudinal section, and in FIG. 3*b* in a schematic axial section representation, it is shown, differently from FIGS. 1*a* and 1*b*, that the electrical connection between the inner conductor coupling device 15 and the outer conductor 1 via the branch wire 7 can be made not only galvanically, but also capacitively.

The branch wire 7 opposite the inner conductor coupling device 15 is shown with a branch wire coupling section 7*a* in the form of a branch wire base 7*a*, which in the case of the variant according to FIG. 3*a* on the left can have a cubic shape, e.g. like dice, but also a cylindrical shape, and in the case of the variant according to FIG. 3*a* on the right can have a spherical shape or also a cylindrical shape. Correspondingly, the recess 1*b*, into which the corresponding branch wire coupling section 7*a* engages, in the material of the outer conductor 1*a* is then also provided. Preferably, the outer conductor recess 1*b* is adapted to the cross-section shape or contour of the branch wire base section 7*a* (although here too differences are possible, and the cross-section shape of the outer conductor recess 1*b* can differ or be a completely different shape from the cross-section shape or contour of the branch wire base section 7*a*).

In the case of the variant on the left in FIG. 3*a*, between the branch wire coupling section 7*a* and the outer conductor recess 1*b*, a solid dielectric 23*a* is provided. This opens up the possibility that the branch wire section 7 is fixed on the outer conductor 1 of the outer conductor housing 10 via said dielectric, and the inner conductor coupling element 115 is positioned firmly and stably in the inner conductor space 21 also via said dielectric. The inner conductor coupling element 15—as mentioned—is also provided with a solid dielectric 23, so that the inner conductor end sections 5*a* are also held and positioned via said dielectric, and the actual inner conductor sections 5*a* do not have to be held and positioned via further dielectric spacers in the inner conductor space 21. In the right-hand variant in FIG. 3*a*, between the branch wire coupling section 7*a* and the outer conductor recess 1*b*, air is provided as the dielectric 23*a*.

The variant according to FIGS. 3*a* (shown in longitudinal section) and 3*b* (which reproduces a transverse section along the line III-III in FIG. 3*a*) also shows that the coupling devices 15 also do not have to be in the same form in the axial longitudinal direction, that is in the extension direction X1 of the inner conductor sections 5*a*, but in the peripheral direction can have different longitudinal extents at different sections, and thus overlapping sections of different sizes with the associated inner conductor end sections 5*c*.

Additionally, the inner conductor sections can also have different diameters, and in the axial longitudinal extent include gradations, at which there is a transition from a smaller diameter to a larger diameter or vice versa. Also, in the region of the coupling elements (e.g. in the region of the inner surfaces of the outer conductors), additional dielectrics which, for example, reach the coupling element or end before it, can be provided. However, for clarity these variants have not been shown in FIGS. 3*a* and 3*b*. Reference is also made here in part to FIGS. 2*a* to 2*k*, which show and reproduce some variants.

On the basis of FIGS. 4*a* to 4*h*, the way in which the coupling can be implemented between the faces 5*d* of the inner conductor sections 5*a* and the additional coupling via the inner conductor end sections 5*b*, mediated via the inner conductor coupling device 15, is also shown.

In the case of the variant according to FIG. 4*a*, the inner conductor end sections 5*c* are formed with same diameter and, for example, the same cross-section shape, approximately round, the inner conductor coupling element being formed with a greater internal diameter than the outer diameter of the inner conductor end sections, so that the inner conductor end sections can dip into the interior 15*e* of the inner conductor coupling device 15, which in this embodiment is in tubular form, to a certain axial length, so that the associated inner conductor faces 5*b* end at the above-mentioned distance A from each other. In this embodiment, the interior 15*e* of the coupling device 15 is filled, e.g. plugged, with a solid dielectric 23, via which the inner conductor sections 5*b* can be held together mechanically.

In the variant according to FIG. 4*b*, the inner conductor end sections 5*c* at the extreme outside are provided, adjacently to their faces 5*b*, with a surrounding annular projection 5*r*, that is a region which has a greater outer diameter than the adjacent inner conductor end section 5*c*. In particular if the inner conductor coupling element 115, which is fully or partly enclosed in the peripheral direction, is plugged and/or filled with the dielectric 23, the result is a particularly favourable mechanical fixing of the inner conductor end sections 5*c*, which are held, not only in the radial direction but also in the axial direction, against the dielectric.

In the case of the variant according to FIG. 4*c*, a surrounding inner conductor groove 5*n* is formed in an end region of the inner conductor end section 5*c* shown on the right, so that the same advantage is achieved. Here too, good axial fixings opposite the inner conductor and dielectric are given.

In the case of the variant according to FIG. 4*d*, it is shown that one inner conductor end section 5*c* is, for example, formed with a blind hole (in general an inner conductor receptacle 5"*c*), into which the second inner conductor end section 5*c*, which is formed with a smaller outer diameter than the blind hole, engages without contact to a certain axial length. In this variant too, on the one hand a direct capacitive coupling between the two end sections 5*c* and between the two thus positioned inner conductor sections 5*a* is implemented, and on the other hand a capacitive coupling from one inner conductor section 5*a* or inner conductor end section 5*c* (which is provided with the above-mentioned inner conductor receptacle 5"*c*) to the inner conductor coupling device 15 which is arranged overlapping with it, and the further capacitive coupling from this inner conductor coupling device 15 to the inner conductor end section 5*c* on the right in FIG. 4*d*. Finally, the dielectric 23 on the right-hand side projects over the coupling device in the radial direction.

In the example according to FIG. 4*e*, the diameters of the inner conductor sections 5*a* are different, as are the central axis of the two shown inner conductor end sections. In FIG. 4*e*, the central axes X2 and X3 are offset from each other, so that the gap of the outer periphery of the inner conductor end section 5*c* on the right does not come to be coaxial to the, for example, tubular or hollow cylindrical inner conductor coupling element. There is also a transition from the inner conductor end section 5*c* on the left in FIG. 4*e* to a reduced final section 5'*c*, which has a smaller outer diameter. The inner conductor end section on the right here has, adjacently to the dielectric 23, a surrounding annular shoulder 5*r*, which has a greater outer diameter than the inner conductor end section which dips into the dielectric.

The variant according to FIG. 4*f* shows only a plate-shaped coupling element 115, which, with a dielectric 23 connected between them, is arranged overlappingly parallel and thus connected to the inner conductor end sections 5*c* (parallel position to them) which run towards each other and end at a short distance A from each other.

The variant according to FIG. 4*g* also shows that the coupling element (even if, for example, it is fully or partly closed in the peripheral direction) does not have to have the same outer or inner diameter throughout its axial length. In this embodiment according to FIG. 4*g*, it is in conical form. Finally, however, other gradations can be provided not only on the inner conductor, but also on the coupling device 15, as is shown, for example, on the basis of FIGS. 4*c* and 4*e* with reference to an elevation 15*e* or 15*s* for the gradation.

FIG. 4*h* shows, only schematically, that in general the inner conductor end sections which are to be coupled directly capacitively do not necessarily have to be in axial extension to each other, but in general can end next to each other. According to FIG. 4*h*, two opposite inner conductor end sections 5*d*, which in cross-section end in the shape of a fork, are shown for the inner conductor end section on the left, into which a reduced inner conductor end section 5*e* of the inner conductor end section 5*c* on the right engages (coaxially or eccentrically), the whole arrangement in this embodiment dipping into the inner conductor coupling device with the end sections, which are directly coupled to each other.

Figure 5B:
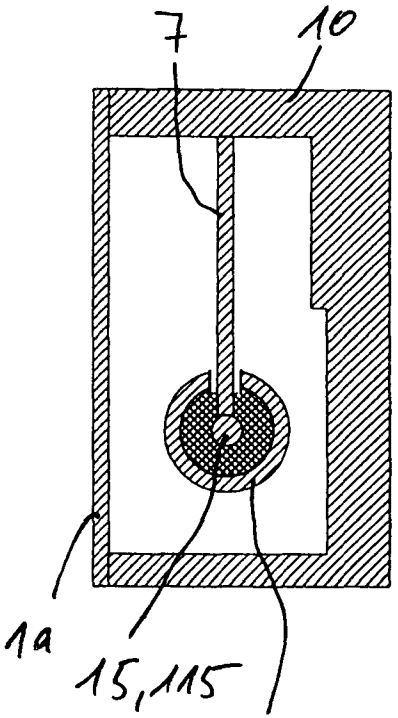
FIG. 5*b* is a schematic axial cross-section along the line V-V in FIG. 5*a;*
Figure 5A:
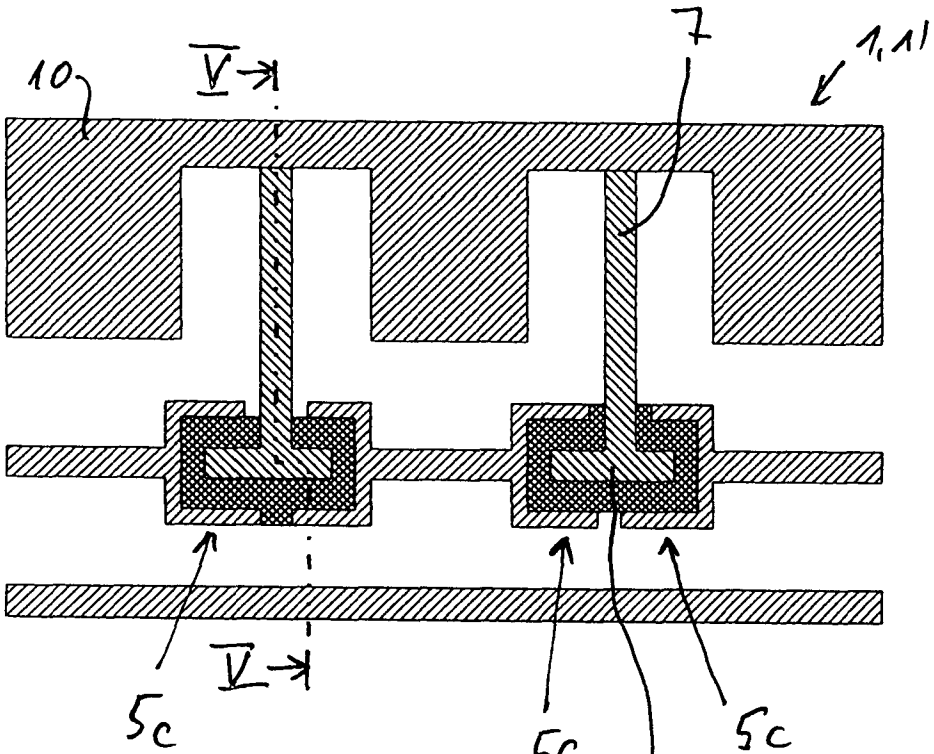
FIG. 5*a* shows a further embodiment according to the invention, in schematic axial section, with different coupling between the inner conductor sections and the inner conductor coupling elements.

The embodiment according to FIG. 5*a* (in longitudinal section) and FIG. 5*b* (in cross-section along the line V-V in FIG. 5*a*) shows another similar modification to the preceding embodiments, virtually in the sense of a reversal of the variant embodiment according to FIGS. 1*a* and 1*b*. In this embodiment according to FIGS. 5*a* and 5*b*, the inner conductor end sections 5*c* of the inner conductor sections 5*b* to be coupled on the face sides end in the shape of a fork or pot or in mixed shapes, the actual inner conductor coupling element 115 then being arranged inside, between the fork-shaped or pot-shaped inner conductor end section. In this way too, the result is the multiply capacitive coupling directly between the inner conductor end sections on the one hand and between the relevant inner conductor end section and the associated inner conductor coupling element on the other.

Figure 6B:
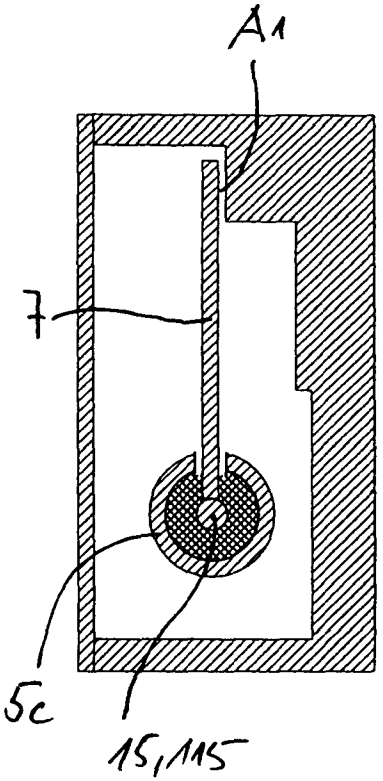
FIG. 6*b* is a cross-section along the line VI-VI in FIG. 6*a;*
Figure 6A:
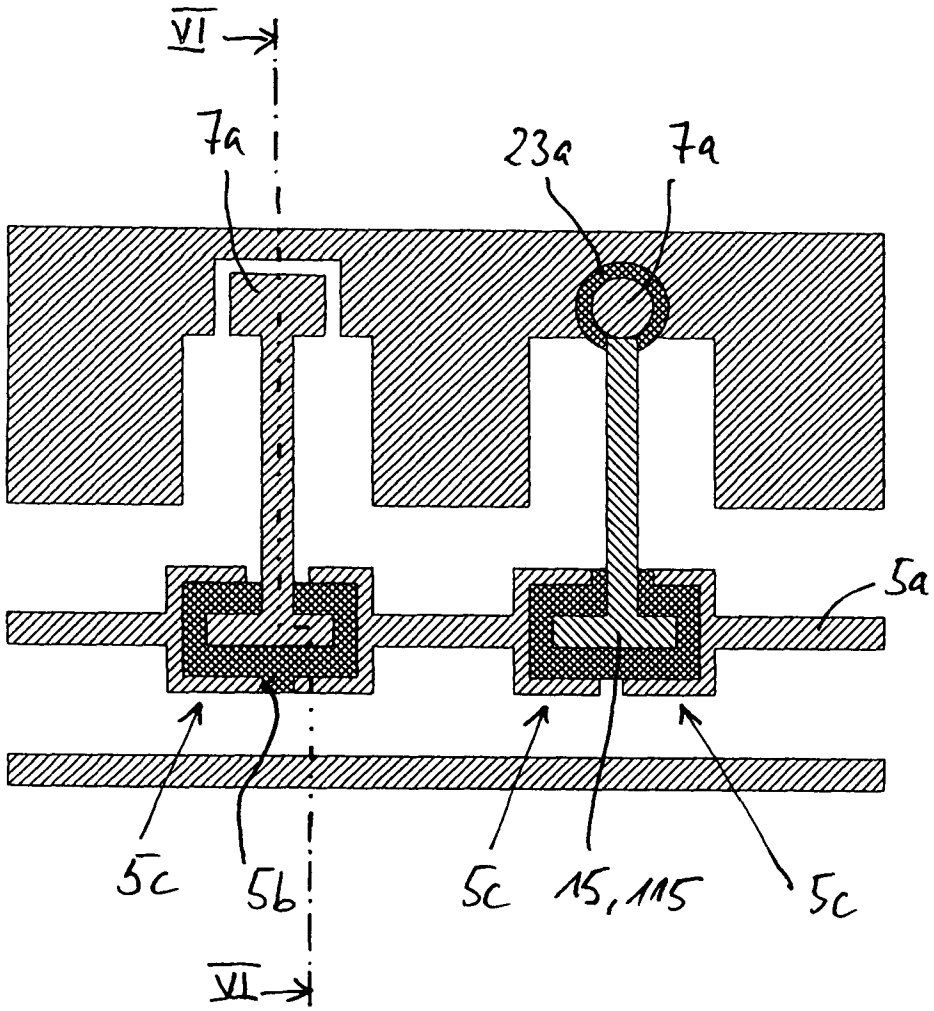
FIG. 6*a* is a further schematic axial section representation through an embodiment which differs from FIG. 5*a*, and in which the branch wire between inner conductor coupling element and outer conductor in the region of the outer conductor is not implemented galvanically but capacitively.

FIG. 6*a* shows an embodiment corresponding to FIG. 5*a*, but again with the difference that—similarly to FIG. 3*a*—the branch wires 7 are not connected galvanically to the outer conductor, but in the region of the branch wire base sections 7*a* are connected capacitively. FIG. 6*b* shows a corresponding cross-section along the line VI-VI in FIG. 6*a*. In this embodiment too, here a solid dielectric or air as dielectric can again be provided on the base section.

In particular, it can also be taken from the cross-section according to FIG. 6*b* that the branch wire coupling section 7*a* can be in the form of a pin or preferably plate-shaped, and comes to rest at a short distance A1 from a correspondingly shaped, here planar coupling plane to the outer conductor 1. If required, here too a dielectric 23' of solid material, and not of air, can be provided. Thus the coupling surface of the outer conductor here runs perpendicularly to the extent of the outer conductor.

Figure 7B:
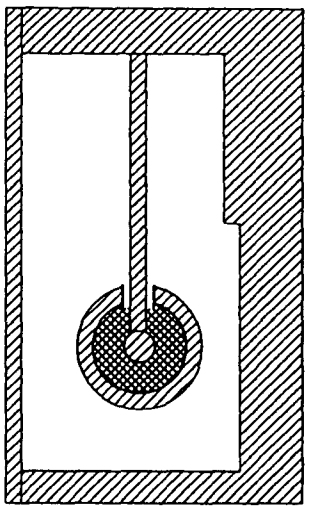
FIG. 7*b* is a cross-section along the line VII-VII in FIG. 7*a;*
Figure 7A:
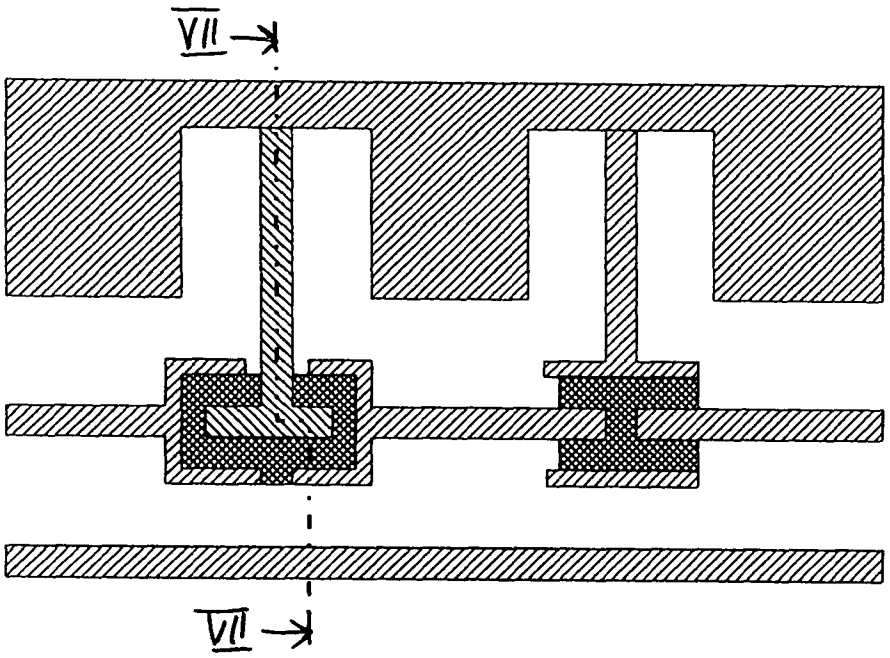
FIG. 7*a* is a longitudinal section through a high pass filter with two blocking poles, in which two different coupling devices according to the invention are used.

On the basis of the axial cross-section according to FIG. 7*a* and the cross-section along the line VII-VII in FIG. 7*a*, it is to be shown that in principle any high pass filter structure according to the invention and according to one of the explained variants or modifications can be connected in series to a common high pass filter. In the variant according to FIG. 7*a*, for example, two high pass filters are connected in series, one high pass filter corresponding by structure to the example according to FIG. 5*a*, and the high pass filter to the right of it corresponding to a variant according to FIG. 1*a*. In this way, a high pass filter with two additional blocking poles is achieved.

Figure 8B:
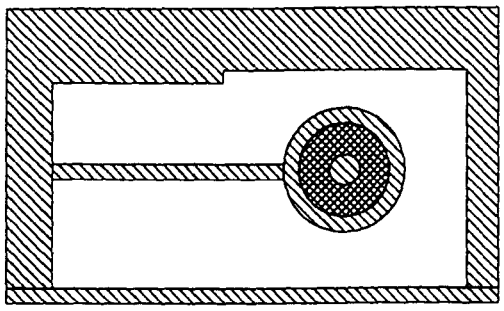
FIG. 8*b* is a cross-section along the line VIII-VIII in FIG. 8*a;*
Figure 8A:
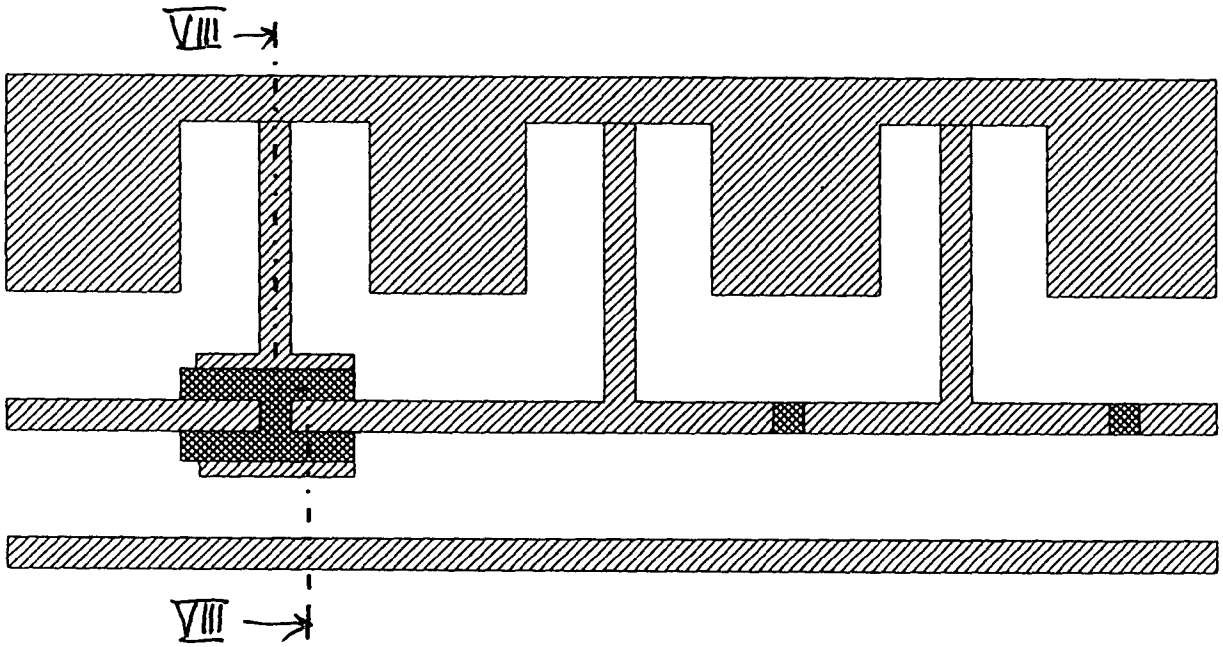
FIG. 8*a* is a schematic longitudinal section through a high pass filter, which includes a high frequency filter according to the invention, which is connected in series to a conventional high pass filter according to the prior art.

The variant according to FIGS. 8*a* and 8*b* shows merely that, for example, even individual high pass filters, which according to the solution according to the invention are shown on the basis of one of the examples explained above, can be connected to a conventional high pass filter structure, as was explained initially with reference to the prior art.

Figure 9B:
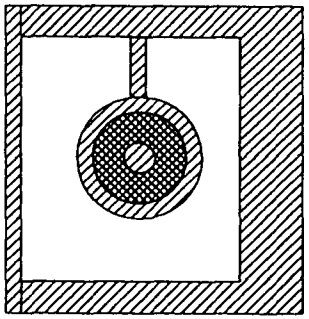
FIG. 9*b* is a cross-section along the line IX-IX in FIG. 9*a;*
Figure 9A:
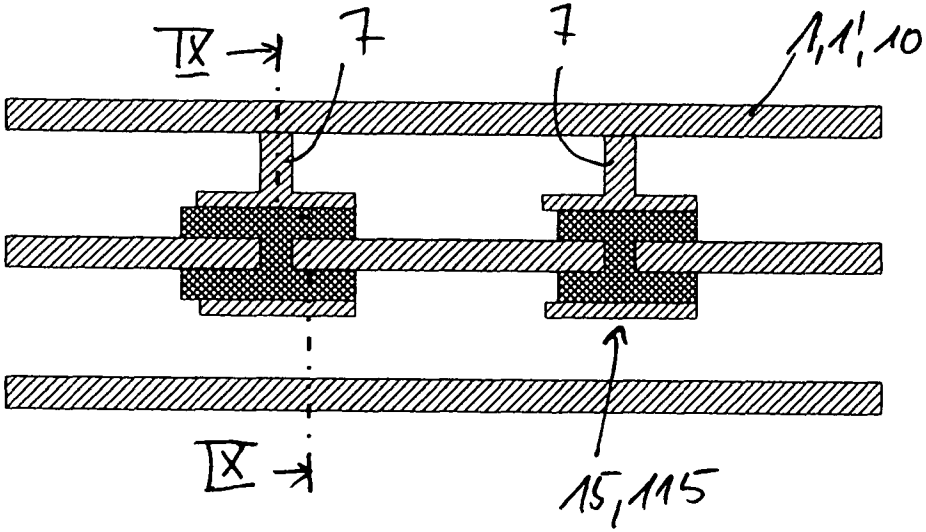
FIG. 9*a* is a longitudinal section through a further, modified embodiment, to clarify that a high pass filter according to the invention does not require an outer conductor extension to extend a branch wire.

In the case of the variant according to FIGS. 9*a* and 9*b*, all that is shown is that the branch wires 7 do not necessarily have to end in branch wire channels 9 in the outer conductor housing 1, i.e. the outer conductor housing does not necessarily have to be provided with an outer conductor housing extension 1' as explained in one of the preceding embodiments. In the case of the variant according to FIGS. 9*a*, 9*b*, for example, an outer conductor housing which is square or tubular in cross-section is used, and in said housing, in the corresponding inner conductor space 21, the inner conductor sections with the coupling elements and the branch wires going away from them are arranged, said branch wires being connected at the end galvanically or capacitively to the outer conductor housing.

The individual branch wires can also be connected at the end galvanically or capacitively on opposite sides to the outer conductor housing, and/or also to the floor and/or cover.

As already mentioned, the individual branch wire channels 9 can also be provided in a corresponding cover construction, so that here the branch wires can be provided and housed.

Figure 10A:
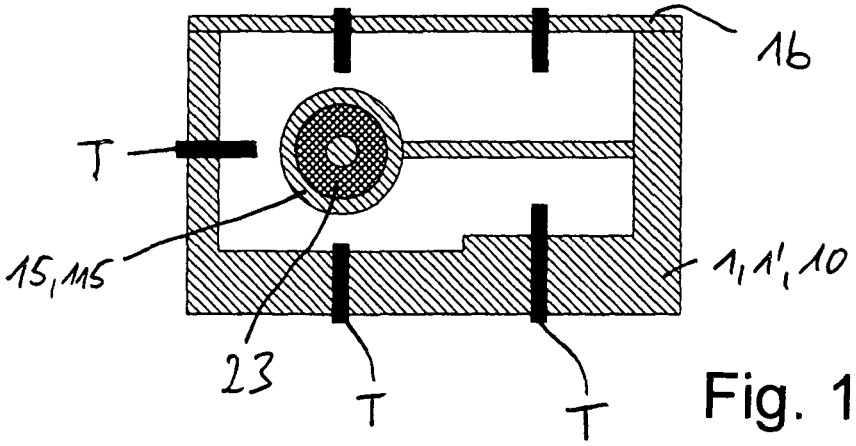
FIGS. 10*a* to 10*c* are three schematic cross-sections through a high pass filter, to explain that further tuning elements for changing the electrical properties of the corresponding wire sections and/or inner conductor coupling elements can be provided.
Figure 10B:
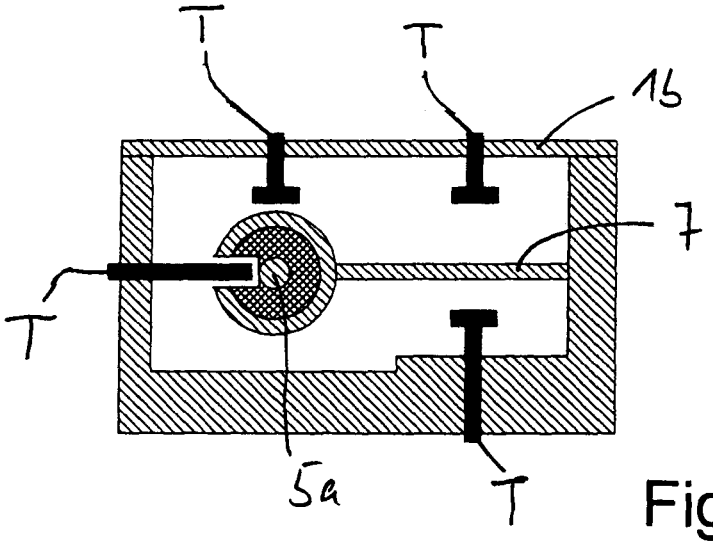
Figure 10C:
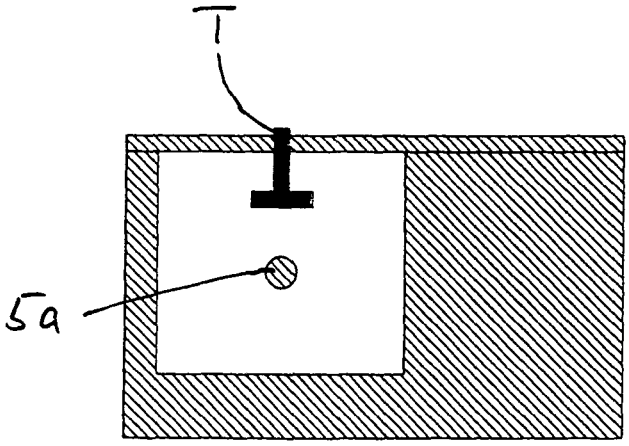

On the basis of FIGS. 10*a* and 10*b*, it is also shown that additional tuning elements T can be provided at one or more locations of the outer conductor housing, preferably adjustable from outside (e.g. by turning them in or out to different distances into the interior 21). In the case of the variant according to FIG. 10*b*, a tuning element T on the right is in the form of a rod, and projects even beyond the opening section 15*d* into the space within the coupling element 115, into a free space which is provided there in the dielectric, and can also be adjusted from outside, preferably by further turning in and out projecting to different distances into the outer conductor housing.

By these actions, which are known per se, the electrical properties or individual wire sections and/or inner conductor coupling elements can be changed, and thus the frequency course of the high pass filter can be differently adjusted corresponding to the requirements and desires.

In the shown embodiments, all electrically conductive structures can consist of metal, metal alloys, for example of cast, milled, turned, deep drawn and/or sheet metal and/or bent parts. However, it is also possible that the correspondingly explained electrically conductive parts consist of an insulator, plastics material, in general a dielectric, and that the electrically conductive parts or surfaces are coated with an electrically conductive surface. Also, mixed forms of metallic components (e.g. for the outer conductors) and parts which are arranged inside such as the coupling element, inner conductor sections or branch wires can also be formed on electrically conductive tracks which are provided with or formed on electrically conductive surfaces, and which for example are also in the form of dielectric materials.

As is shown on the basis of the explained embodiments, within the invention in principle a high pass filter with coaxial structure (i.e. with an inner conductor or inner conductor section running into an outer conductor) can be implemented, said high pass filter including at least one additional metallic or electrically conductive inner conductor coupling element and/or the corresponding inner conductor coupling device for generating additional blocking poles below the pass band. For each inner conductor coupling element 115 which is used, i.e. in general for each inner conductor coupling device 15 which is used, one blocking pole can be achieved. By corresponding multiple connection of the high pass filter structures according to the invention, therefore, a high pass filter with multiple blocking poles offset from each other can be constructed.

Figure 11:
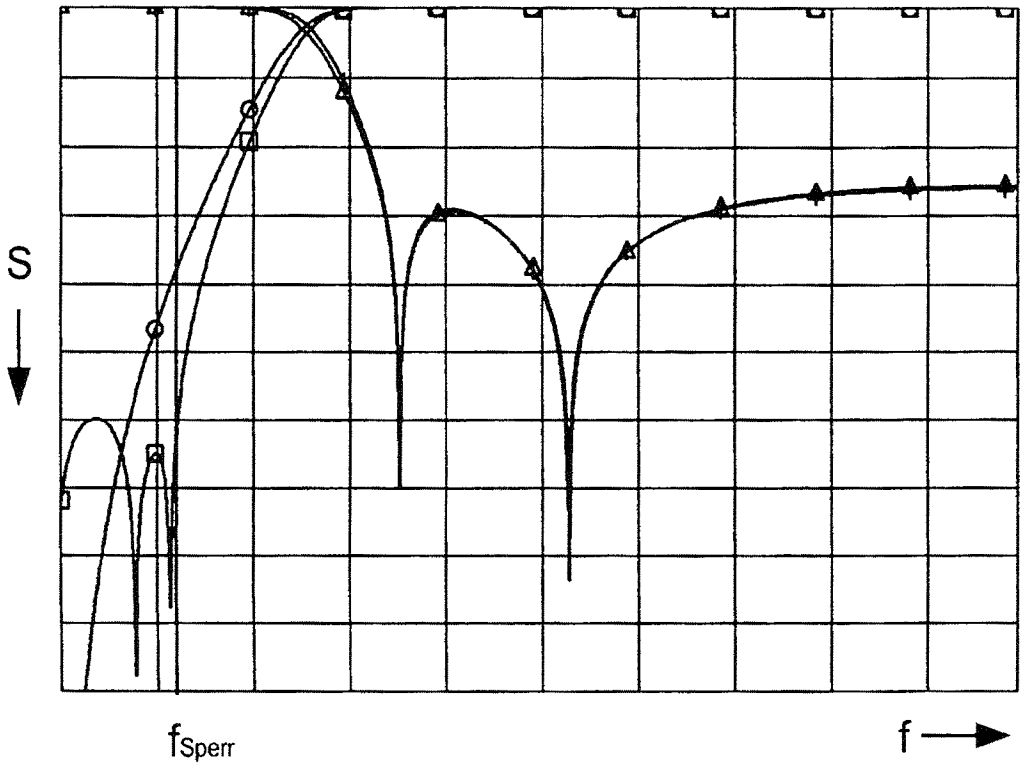
FIG. 11 is a diagram representing a comparison of S parameters between the high pass filter grade 5 according to the invention with two inner conductor coupling elements, and a high pass filter grade 5 according to the prior art and FIGS. 8*a* and 8*b* (plotted against the frequency)

On the basis of FIG. 11, for comparison, the S parameters for the case of a high pass filter according to the invention of degree 5, with two inner conductor coupling elements and resulting S parameters, are shown with reference to a solution according to the prior art (FIGS. 12*a* and 12*b*), plotted against the frequency. The curves marked with a triangle and a square concern the high pass filter according to the invention, whereas the measurement points marked with a | or a circle concern a high pass filter according to the prior art according to FIGS. 8*a* and 8*b*. It can thus clearly be seen that through the invention, with the use of two inner conductor coupling elements, two additional blocking poles below the pass band f_sperr occur, so that a considerable steepening of the filter characteristic below the pass band f_sperr is generated. The result on the y axis is then the magnitude of the reverse attenuation, which increases in the downward direction of the arrow.

The explained high pass filter can typically be used in the frequency range from 100 MHz to 10 GHz.

The electrical coupling of the individual conductor sections, i.e. of the individual conductor pieces 5*b* to each other, can be generated via the distance of the faces of the directly coupled inner conductor sections and via the distance between the inner conductor end section 5*c* (or its outer surface 5*d*) and the adjacent upper and/or inner surface 15*c* of the inner conductor coupling device 15, in particular of the inner conductor coupling element 115, and by the use of a dielectric, and/or its magnitude can be differently set. The face-side capacitive coupling of the line pieces generates a blocking pole below the pass band. The inner conductor coupling elements are galvanically connected or capacitively coupled to the outer conductor.

Finally, it is also mentioned that the inner conductors and also the coupling devices can be formed from a very wide variety of originally electrically conductive materials or from dielectrics with electrically conductive coatings, and for example the inner conductor can also be produced from a planar or sheet metal material, as well as the branch wire, for example. In this respect too there are no restrictions.

With one of the explained high pass filter structures, for example a duplexer consisting of a low pass filter and a high pass filter can be constructed. For a high pass filter, the high frequency filter structure according to the invention can be used, and for the low pass filter, a conventional filter structure can be used.

The invention claimed is:

1. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the at least two inner conductor sections, the at least one branch wire extending between the at least one inner conductor coupling device element and the outer conductor, wherein the at least one inner conductor coupling device element is in a tubular form defining an interior, the inner conductor end sections of the at least two inner conductor sections being inserted into the interior of the at least one inner conductor coupling device element.

2. The high frequency filter according to claim 1, wherein the at least one inner conductor coupling device element is held mechanically via the at least one branch wire, which is connected galvanically to the outer conductor, or via the at least one branch wire, which is coupled capacitively to the outer conductor using a dielectric.

3. The high frequency filter according to claim 1, wherein the at least one inner conductor coupling device element is not completely closed in a peripheral direction, and defines an opening section.

4. The high frequency filter according to claim 3, wherein the at least one inner conductor coupling device element surrounds the inner conductor end sections of the at least two inner conductor sections in a surrounding range of more than 10°.

5. The high frequency filter according to claim 3, wherein the at least one inner conductor coupling device element surrounds the inner conductor end sections of the at least two inner conductor sections by less than 20°.

6. The high frequency filter according to claim 1, wherein the at least two inner conductor sections are held with the at least one inner conductor coupling device element using a solid dielectric, and/or the at least two inner conductor sections are held with an inner surface of the outer conductor using a solid dielectric.

7. The high frequency filter according to claim 1, wherein the capacitively coupled inner conductor end sections are coaxial to each other, and arranged coaxially or eccentrically to the at least one inner conductor coupling device element.

8. The high frequency filter according to claim 1, wherein the at least one branch wire, at an end thereof, opposite the at least one inner conductor coupling device element, is connected galvanically to the outer conductor.

9. A high frequency filter according to claim 1 wherein the outer conductor, the at least one inner conductor coupling device element and the inner conductor end sections of the at least two inner conductor sections have different diameters, different cross-section shapes and/or different forms, are in the form of pins, forks and/or pots, and/or have or include different outer and/or inner diameters, gradations and/or projections, or in the longitudinal direction at least have sections with conically changed outer or inner surfaces.

10. The high frequency filter according to claim 1, wherein:

a) the at least one inner conductor coupling device element has a square, rectangular, n-polygonal cross-section shape and/or is formed with concave arc sections, and/or b) inner or surface sections of the at least one inner conductor coupling element facing the inner conductor end sections of the at least two inner conductor sections have surfaces which extend straight or stand at an angle to each other or are provided with arc-shaped surface sections, and/or c) surface sections of the at least one inner conductor coupling element facing away from the inner conductor end sections of the at least two inner conductor sections toward the outer conductor are straight, stand at an angle to each other, or have curved surface sections.

11. The high frequency filter according to claim 1, wherein the at least one branch wire is provided or extends in an inner conductor space or in a branch wire channel extending transversely away from the at least one inner conductor coupling device element, the branch wire channel being provided in an outer conductor housing or in an outer conductor cover.

12. The high frequency filter according to claim 11, wherein the at least two inner conductor end sections are formed similarly or differently, so that they engage with each other.

13. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the at least two inner conductor sections, the at least one branch wire extending between the at least one inner conductor coupling device element and the outer conductor, wherein the at least one branch wire, at an end thereof, opposite the at least one inner conductor coupling device element, is coupled capacitively to the outer conductor.

14. The high frequency filter according to claim 13, wherein the at least one branch wire comprises a branch wire section, coupling section or base section, and a dielectric of air or solid material is arranged in an outer conductor recess thereof.

15. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the at least two inner conductor sections, the at least one branch wire extending between the at least one inner conductor coupling device element and the outer conductor, wherein the inner conductor end sections of the at least two inner conductor sections are inserted at different distances into the at least one inner conductor coupling device element, or overlap with different lengths with the at least one inner conductor coupling device element.

16. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the at least two inner conductor sections, the at least one branch wire extending between the at least one inner conductor coupling device element and the outer conductor, wherein multiple pairs of the at least two inner conductor sections are connected in series via an associated inner conductor coupling device element for each coupled pair of the at least two inner conductor sections, and the respective associated at least one inner conductor coupling device element is configured to generate an additional blocking pole below the pass band of the filter.

17. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the at least two inner conductor sections, the at least one branch wire extending between the at least one inner conductor coupling device element and the outer conductor, wherein the filter includes multiple pairs, coupled in series, of the at least two inner conductor sections, and associated plural at least one inner conductor coupling device elements.

18. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the capacitively coupled at least two inner conductor sections, the at least one branch wire extending between the at least one inner conductor coupling device element and the outer conductor, wherein the at least one inner conductor coupling device element is flat-shaped or plate-shaped, the inner conductor end sections of the at least two inner conductor sections over-lapping or arranged side by side with the at least one inner conductor coupling device element, wherein the filter has a passband, and the at least one inner conductor coupling device element is configured to provide at least one blocking pole at a frequency that is below the filter passband.

19. The high frequency filter of claim 18 wherein the respective inner conductor end sections of the at least two inner conductor sections each have a central axis extending along a first direction, and wherein the respective inner conductor end section central axes are arranged to extend parallel to each other and are laterally displaced relative to each other in a second direction transverse to the first direction.

20. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the capacitively coupled at least two inner conductor sections, the at least one branch wire extending between the at least one inner conductor coupling device element and the outer conductor, wherein the at least one inner conductor coupling device element is in a flat-shaped or plate-shaped form defining an interior, the inner conductor end sections of the at least two inner conductor sections being inserted into the interior of the at least one inner conductor coupling device element.

21. The high frequency filter according to claim 20, wherein the at least one inner conductor coupling device element is held mechanically via the at least one branch wire, which is connected galvanically to the outer conductor, or via the at least one branch wire, which is coupled capacitively to the outer conductor using a dielectric.

22. The high frequency filter of claim 20 wherein the respective inner conductor end sections of the at least two inner conductor sections each have a central axis extending along a first direction, and wherein the respective inner conductor end section central axes are arranged to extend parallel to each other and are laterally displaced relative to each other in a second direction transverse to the first direction.

23. The high frequency filter of claim 20 wherein the at least one inner conductor coupling device element provides first and second series-connected capacitive couplings, the first series-connected capacitive coupling being with a first of the inner conductor end sections of the at least two inner conductor sections, the second series-connected capacitive coupling being with a second of the inner conductor end sections of the at least two inner conductor sections.

24. The high frequency filter of claim 20 wherein the filter has a passband, and the capacitive coupling additionally generates, via the at least one inner conductor coupling device, additional blocking poles outside of the filter passband.

25. A high frequency filter comprising:

an outer conductor, an inner conductor arrangement comprising at least two inner conductor sections having inner conductor faces and inner conductor end sections, the at least two inner conductor sections being capacitively coupled at the inner conductor end sections thereof, and a gap being formed therebetween;

at least one branch wire, via which an electrical connection between the inner conductor arrangement and the outer conductor exists, at least one inner conductor coupling device element being arranged in an at least partly overlapping arrangement with the inner conductor end sections of the capacitively coupled at least two inner conductor sections, the at least one branch wire extending between the at least one inner conductor coupling device element and the outer conductor, wherein the at least one inner conductor coupling device element is flat-shaped or plate-shaped, the inner conductor end sections of the at least two inner conductor sections over-lapping or arranged side by side with the at least one inner conductor coupling device element, wherein the at least one inner conductor coupling device element comprises plural series-connected inner conductor coupling device elements each providing a blocking pole.

26. The high frequency filter of claim 25 wherein the respective inner conductor end sections of the at least two inner conductor sections each have a central axis extending along a first direction, and wherein the respective inner conductor end section central axes are arranged to extend parallel to each other and are laterally displaced relative to each other in a second direction transverse to the first direction.

* * * * *